United States Patent [19]
Hart et al.
[11] 4,340,982
[45] Jul. 27, 1982

[54] HYDROTHERAPY BATH OR SPA

[76] Inventors: James F. Hart; Deborah L. Hart, both of 2012 NE. 17th Ter., Fort Lauderdale, Fla. 33305

[21] Appl. No.: 246,957

[22] Filed: Mar. 24, 1981

[51] Int. Cl.³ ..... E03C 1/02; A47K 3/02

[52] U.S. Cl. ..... 4/541; 4/542; 4/492; 4/579; 4/571

[58] Field of Search ..... 4/542, 571, 492, 573, 4/541, 559, 578, 579

[56] References Cited

U.S. PATENT DOCUMENTS

| | | | |
|---|---|---|---|
| 493,194 | 3/1893 | Stifel | 4/591 |
| 735,514 | 8/1903 | Homeier | 4/591 |
| 1,369,638 | 2/1921 | Edmonds et al. | 4/573 |
| 1,450,827 | 4/1923 | Wood | 4/573 |
| 1,454,112 | 5/1923 | Graves | 4/571 |
| 2,679,652 | 6/1954 | Eyring | 4/541 |
| 3,263,678 | 8/1966 | Everston | 4/559 X |
| 3,441,960 | 5/1969 | Norton | 4/578 X |
| 3,577,571 | 5/1971 | Bellinson | 4/492 |
| 3,890,656 | 6/1975 | Mathis | 4/542 |
| 3,946,449 | 3/1976 | Mathis | 4/542 |
| 4,240,166 | 12/1980 | Altman et al. | 4/542 |
| 4,241,464 | 12/1980 | Buckwalter | 4/492 X |
| 4,249,522 | 2/1981 | Carrier | 4/573 X |
| 4,264,039 | 4/1981 | Moreland | 4/492 X |

*Primary Examiner*—Henry K. Artis
*Attorney, Agent, or Firm*—Oltman and Flynn

[57] ABSTRACT

A therapeutic bath or spa that includes providing aerated streams of water that are injected under pressure into desired areas of the bath receptacle, and a variably positionable occupant support device that can be moved to any desired position relative to the aerated pressure streams to obtain the desired occupant impact pressure and comfort. The spa receptacle includes air and water chambers in tandem integrally formed in a manifold that is coupled around the exterior of the spa receptacle shell, with apertures disposed through the shell and the manifold at desired locations to provide aerated streams of water around the spa. The apertures are repositionable. The periphery of the receptacle shell includes a vertical groove or spaced holes on or near its exterior edge that may encompass the entire receptacle or sections thereof. The occupant support described above may include a resilient, horizontally disposed support and anchor hooks or pins and lines which are fixed to each end of the support for connection into the peripheral groove or holes extending in or around the outside of the spa receptacle shell. The pins or hooks may be anchored at any desired location within the groove or holes thus allowing for alignment and positioning of the occupant support in any direction relative to the inside of the spa and the water jet array within the spa receptacle.

10 Claims, 11 Drawing Figures

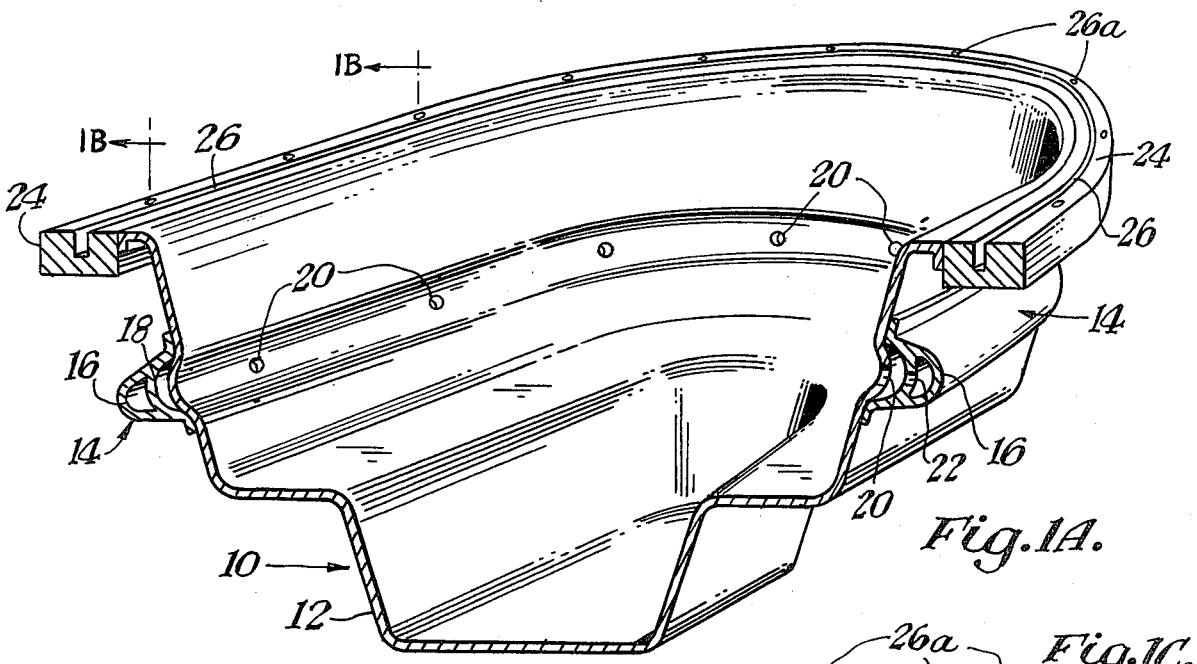
Fig. 1A.
Fig. 1B.
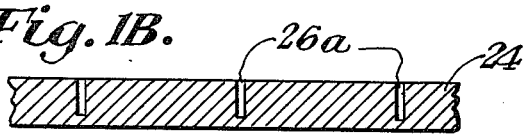
Fig. 1C.
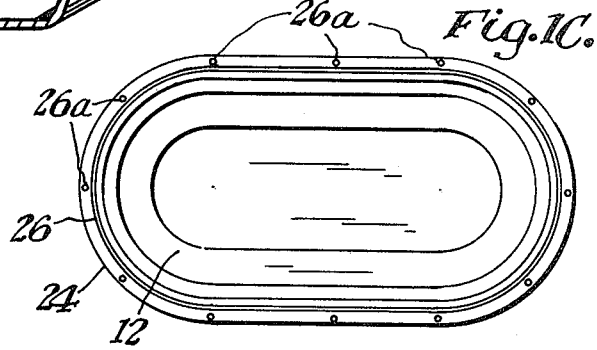
Fig. 2.
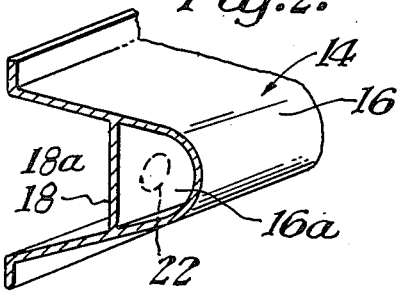
Fig. 4.
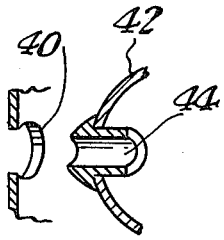
Fig. 3.
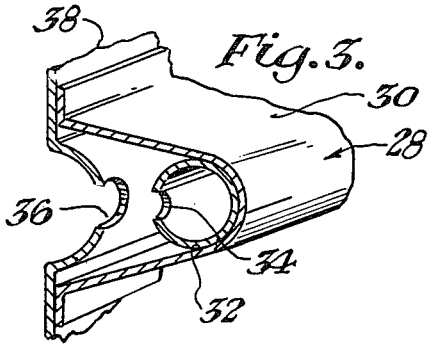
Fig. 3A.
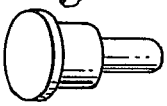
Fig. 5.
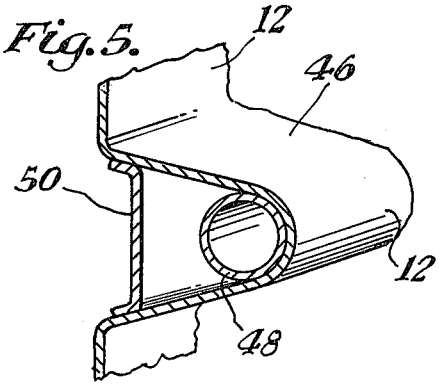

HYDROTHERAPY BATH OR SPA

BACKGROUND OF THE INVENTION

This invention relates to an improved hydrotherapeutic spa, tub or swimming pool, and in fact in any system that utilizes streams of impinging water mixed with air for therapeutic purposes and to an occupant support device which permits variable positioning without projecting attachment devices.

Many of the systems in present use today employ complex and expensive piping systems for the injection of water and air around the inside of the tub area. Oftentimes it is discomforting to the occupant of the spa in that the impact velocity may be too harsh for the occupant. Conventional spas usually employ several high pressure jets (usually a quarter H.P. pump per jet) with Venturi nozzles which add air to create a bubbling stream of water for soothing the body. Many conventional spas also employ an air pump which forces compressed air into the spa through channels which release the air through many holes located under water. The customary quarter horsepower jet is often too powerful for the occupant to withstand direct contact for any length of time. In many cases the air pump is turned on and the water pump turned off or the jets diverted to miss the occupant. If the water pump is turned off the spa filter is inactivated.

Electrical power requirements are also very high for conventional systems. The water pump, the air compressor, and the water heater, if used, all are high energy users.

The present invention improves upon conventional systems by requiring much less electrical power while still achieving the therapeutic effects of injected streams of water and air into the spa or bath. The present system reduces the requirement for the use of air pumps without reducing the aerated or bubble effect, due to more jets and broader coverage.

The present invention also provides for more versatile seating of occupants by including a multiple positioning support system that can be suspended anywhere in the pool in any direction to allow for total versatility in the seating arrangements in the pool. Many conventional spas and baths presently employed are premolded with particular molded seating sections therein, thus defining the exact seating location in a permanent fashion. With the present invention, using the occupant support device, the support may be positioned over existing seating to provide a variety of positions. Another advantage of the seating versatility is that the support may be positioned relative to the water jets to provide the angle and force of impingement desired by the user. This provides for a variable therapeutic effect from the water jets.

SUMMARY OF THE INVENTION

An improved spa or therapeutic bathing tub system that utilizes submerged streams or jets of impinging water combined with air which are directed against the occupant or occupants for hydrotherapy or occupant relaxation, that increases the efficiency of operation while enhancing the positioning of the occupant within the receptacle or bathing shell.

The first facet of the invention includes use of water and air manifolds in tandem which are affixed around the peripheral (below the water line) portion of the spa receptacle and are structured to reduce plumbing and the necessity of air compressors. The manifold includes a first passage which is disposed around the receptacle shell and which receives water under pressure that is forced from the passage through small apertures in the passage, then through an air chamber and then into the receptacle itself. A second passage is formed adjacent the first passage, and the second passage which is also a part of the manifold is vented to the atmosphere or other air source to allow the passage of air therethrough. In one embodiment the second passage is formed by the walls of the manifold, by the first passage and by the shell of the spa and includes a conduit disposed within the manifold. The receptacle shell also includes a plurality of small holes or apertures which are coaxially formed with holes in the first passage to allow for water to be forced into the pool. A Venturi effect is created by water under pressure in the first passage as it exits the manifold openings in the receptacle shell, which causes the addition of air (and bubbles) formed in the fluid stream as it is injected into the pool through the air vented passage.

The spa receptacle wall itself may include a concave section or area around the receptacle shell, the band area which receives the apertures for the aerated stream through the receptacle shell. The purpose of the concave surface area that receives the receptacle shell apertures is to prevent an occupant who leans against the receptacle shell area at an aperture from disturbing the flow of the aerated water or forcing the water into the manifold disturbing the other aerated streams. Therefore it prevents physical contact or blockage of any particular aperture around the receptacle shell.

The system may also include a plurality of plugs that are watertight that can be disposed and fit into the holes in receptacle shell and the manifold to allow one to change or reposition the impingement streams around the inside of the spa receptacle. Thus, if there are some particular apertures that provide for the impingement stream that are not desired in a particular location one merely need to insert the particular plug in those areas to prevent flow therefrom. Also because of the location of the manifold and the air and water chambers that are in tandem it is possible to drill additional holes in different areas, after installation, if desired.

The manifold, from a construction standpoint, may be economically and efficiently constructed to greatly reduce the overall cost of the system. Specifically, a separate formed channel may be affixed all the way around the side of the pool shell and may include either an extruded member that has a first and second passage already disposed therein or a shaped member to which a separate conduit or pipe is added throughout. Once in place, the holes through the side of the spa or bathing tub shell may be drilled as well as drilling into the first passage in the manifold. This insures alignment of the apertures between the first passage and the actual shell of the pool.

The first passage is connected to a water pump, such that water under pressure is forced into the first passage. The second passage adjacent the first passage is vented to atmosphere. Water under pressure is forced out through the holes in the first passage which are coaxially aligned with the holes in the side of the tub or shell.

An insertable jet may be bonded or attached to the hole in the first manifold to achieve a flow or dispersion of the water stream other than provided by a drilled hole.

A second feature of the invention is the utilization of movable seating arrangements which allow for complete variety in the location of the seating array in the spa or pool. This is accomplished by having, around the lip or edge of the pool at ground level, a groove or series of holes in the decking or molded into the pool or between the pool and the decking. The groove or holes receive anchor hooks or pins at desired positions, which are affixed to the ends of a flexible, semi-rigid or rigid support with lines so that the hooks or pins will anchor the support. As an example, one or more occupant support devices with lines and anchor hooks or pins at each end can be affixed across longitudinal or lateral segments of the pool or spa at virtually any desired angle (especially with respect to the water jets around the side of the spa) so that the occupant can recline in a desired location in the support and receive a desired spray impact from the jet array around the pool. This allows for versatility by allowing permanent seating and removable reclining or semi-reclining positions.

To utilize the variable seating positioning, the occupant merely needs to take the anchor hooks or pins and position them firmly in the peripheral groove or holes around the pool so that the occupant support is arranged in the desired position and supported at its ends by the lines and anchor hooks or pins in the groove or holes. When the occupant support device is removed, the hooks or pins and attendant lines stay with the support device, leaving no protruding attachments, for safety.

It is an object of this invention to provide an improved hydrotherapy spa or bath that is highly efficient in operation that reduces energy consumption for achieving water jet and aerated action and has greatly reduced fabrication costs.

It is another object of this invention to provide an improved hydrotherapy spa in which therapeutic action from water jet impact is achieved without occupant discomfort.

And yet another object of this invention is to provide a spa or pool that provides for multiple and variable occupant positioning within the pool or spa, while also allowing the occupant to vary his positioning relative to the impact jet to achieve the desired impact comforts.

In accordance with these and other objects which will be apparent hereinafter, the instant invention will now be described with particular reference to the accompanying drawings.

BRIEF DESCRIPTION OF THE DRAWINGS

FIG. 1A shows a perspective view partially cut away of a spa or bath receptacle shell utilized in the present invention.

FIG. 1B shows a fragmentary side elevational view in cross-section showing the holes disposed in the edge of the spa.

FIG. 1C shows a top plan view of a representative spa shell including the surrounding edge having a groove and series of holes disposed therein.

FIG. 2 shows a perspective cut away view of one embodiment of the manifold used in the present invention.

FIG. 3 shows a perspective cut away view of an alternate embodiment showing a manifold useful in the present invention.

FIG. 3A shows a plug that can be used in the present invention for repositioning or closing particular apertures.

FIG. 4 shows a partially cut away fragmentary view of the insertable jet utilized in the present invention.

FIG. 5 shows yet another alternate embodiment of the manifold structure utilized in the present invention.

PREFERRED EMBODIMENT OF THE INVENTION

Figure 6:
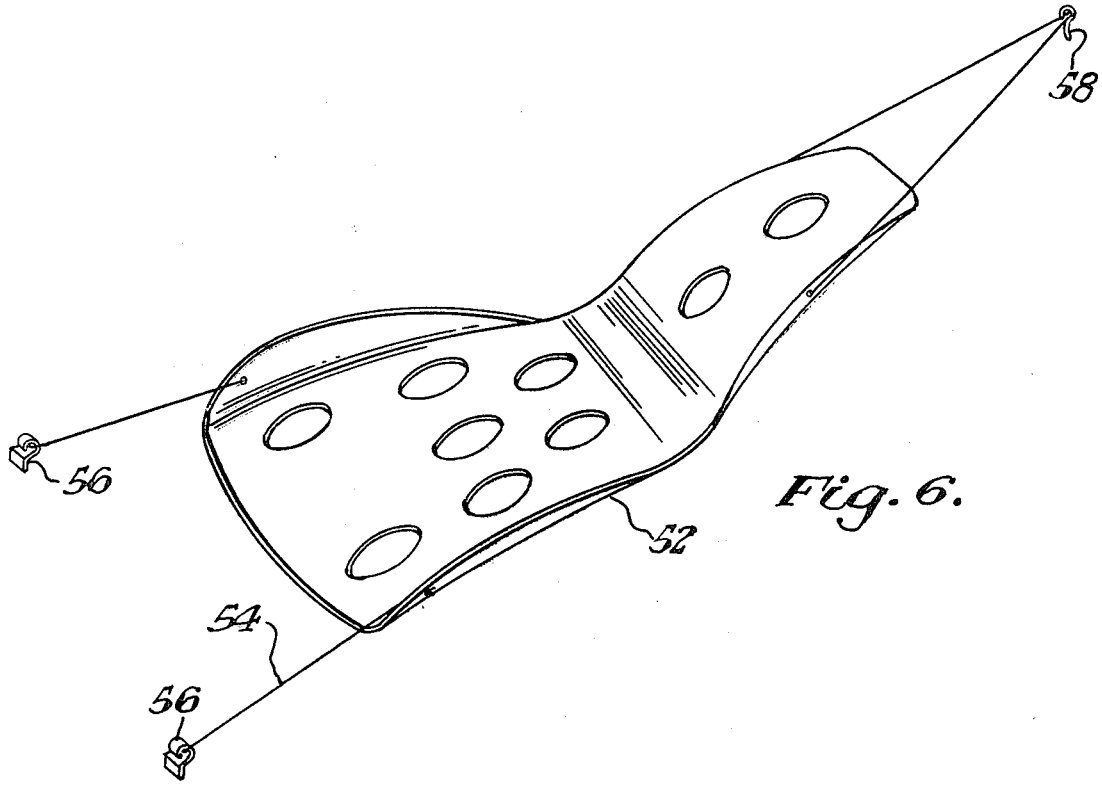
FIG. 6 shows a perspective view of an occupant support that may be utilized in the present invention.

Referring now to the drawings and specifically FIG. 1, the present invention is shown installed in a spa 10 and shows in cut-away a waterproof spa receptacle shell 12 that is shaped to receive water to form a hydrotherapy spa or bath enclosure. The principles exhibited here may also be utilized in swimming pools on a larger scale.

The receptacle shell 12 (which may be molded plastic or fiberglass or concrete) includes a manifold 14 which is mounted around the shell periphery and below the intended water line that includes an outer "U" shaped enclosure 16 with an inner wall 18 forming a partition therein, dividing the inside of the manifold 14 into two distinct passages.

FIG. 2 is helpful to show the manifold 14 in greater detail. The outermost passage **16*a* is coupled to a water pump under pressure and acts as the first passage for carrying water which is forced through aperture 22 in wall 18 and through apertures 20 which are disposed around the shell to direct the water into the receptacle or bath itself. Note that during construction apertures 20 and 22 are coaxially aligned and may be formed simultaneously. In other words after the manifold 16 has been affixed to the shell, the apertures 20 and 22 may be drilled together. As shown in FIG. 2, the passage 16*a* which receives water under pressure from a pump (not shown) then acts as a first passage manifold so that water under pressure exits through aperture 22. As it passes through chamber 18*a* (then through aperture 20 in shell 12) air in passage 18*a* through the Venturi effect is brought into the water stream. Passage 18*a* is vented to atmosphere. As shown in FIG. 1, the manifold 14 overall may be affixed to the shell 12** by any conventional method. The manifold can be fabricated separately at very low cost thus replacing the expensive systems shown in the past for the water injection into the receptacle.

FIGS. 3, 4 and 5 show alternate embodiments of manifold systems that could be employed. For example, as shown in FIG. 3, an outer member 28 is formed and is substantially U-shaped and has a conduit 32 disposed therein. Apertures 34 and 36 may be formed after the member 30 has been affixed to the spa shell 38. FIG. 4 shows a conduit 42 used with a preformed jet passage 44 in conjunction with aperture 40. By varying the internal configuration of the jet passage 44 (or orifice) the fluid jet may be changed as to dispersion and flow effecting the contraction and velocity of the jet and entrained air.

FIG. 3A shows a plug that can be used to fit into particular apertures 20 in order to close off the aperture. Note that the plug has different sections of different diameters. This allows for closure of the aperture in the manifold and the exposed aperture 20 in the spa shell. By using the plugs shown in FIG. 3A a particular aperture can be temporarily or permanently closed off to allow repositioning of the various impact streams experienced in the spa enclosure. The plug shown in FIG. 3A is sized in this diameter so that the body can fit snuggly and firmly fit in the particular apertures. The plug could further be glued permanently in place.

FIG. 5 shows yet another alternate embodiment of the manifold structure in which the spa shell 12 is preformed to make the manifold 46 and includes conduit 48 and cover plate 50.

Referring back to FIGS. 1A, 1B, and 1C, another feature of the invention is shown which includes a solid lip 24 of a base material such as concrete or the like that is formed around the rim of the shell 12. Disposed within the base rim 24 is a longitudinal groove 26 that extends around the entire periphery of the tub or spa. Also holes 26*a* are shown disposed around the periphery.

Figure 7:
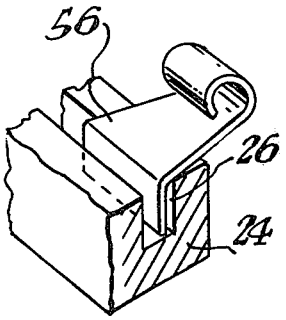
FIG. 7 shows one embodiment of an anchor hook utilized with the occupant support of FIG. 6 in the present invention.
Figure 8:
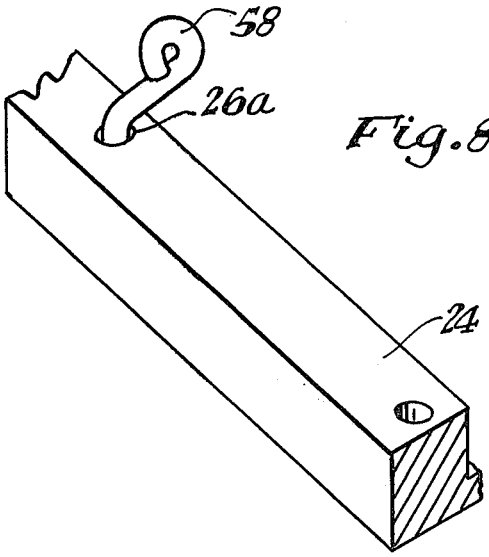
FIG. 8 shows an alternate pin that is used for anchoring the occupant support shown in FIG. 6.

FIGS. 7 and 8 show anchoring hooks 56 and pins 58 respectively which fit into groove 26 or hole 26*a* in FIG. 1 to anchor the occupant support shown in FIG. 6. Occupant support 52 having supporting lines 54 that are mounted to the anchor hooks 56 and pins 58. By proper adjustment of the lines 54 and the location of the anchor hooks 56 and pins 58 within the rim groove 26 or holes 26*a*, one or more occupant supports 52 can literally be disposed in any desired position around the pool or spa. This allows for arrangement of the support relative to the apertures 20 so that the occupant can be positioned at a desired location relative to the impact spray.

The hooks and pins have a vertical portion that fits snuggly into the groove 26 or hole 26*a*. Tension on the hooks through the lines from the occupant support will then wedge the hook against the groove wall, holding it firmly in place during operation. The hooks can further be slid around the groove for positioning at any desired location.

The pins 58 are individually placed in holes 26*a* and may be used as an alternative to the hooks 56.

Another advantage of the particular invention as shown is the fact that since the occupant supports can be arranged in any desired location and the fact that the support can be arranged relative to the direction of impact fluid from the apertures 20, a variable flow and pressure effect can be achieved without requiring variable flow pumps or aerators so that the comfort level of the occupant can be achieved merely by arranging the position of the support relative to the apertures providing variable impact and flow water.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A hydrotherapy system having:

a waterproof shell defining a receptacle for use as a spa, tub or swimming pool, said shell having means forming a plurality of first holes spaced apart along its interior;

and multiple jet manifold means defining a water passageway extending along the outside of said shell at said holes and an air passageway located between said water passageway and the outside of said shell and opening into the interior of the shell through said holes, said manifold means having a second hole leading from said water passageway into said air passageway at each of said first holes to provide aerated impact water through said first holes;

said shell forming a wall of said manifold means.

2. A hydrotherapy system according to claim 1, wherein:

each of said second holes in said manifold means is aligned with and smaller than a corresponding first hole to create a venturi effect;

and further comprising:

a plurality of plugs removably insertable into aligned first holes and second holes in said manifold means, each of said plugs having a larger segment which is complementary in size and shape to the first hole and having a smaller segment which is complementary in size and shape to the second hole in said manifold means and is positioned for reception in said second hole in said manifold means when said larger segment of the plug is received in the aligned first hole to alter the overall hydrotherapeutic flow pattern.

3. A hydrotherapy system according to claim 1, wherein:

said air passageway and said water passageway extend along the outside of said shell;

the outside of said shell defines the inner side of said air passageway;

and said air passageway is bounded on its outer side by a wall separating it from said water passageway and formed with said second holes in said manifold means.

4. A hydrotherapy system according to claim 1 in which said shell defines the outer wall of said manifold means and said first holes are in an inner wall attached to and part of said shell.

5. In a hydrotherapy system having:

a waterproof shell defining a receptacle for use as a spa, tub or swimming pool;

the improvement which comprises:

means defining a rim extending along the top of said shell on the opposite sides of the receptacle, said rim being formed with an elongated groove extending down from the top of said rim at least partially around the receptacle;

and an occupant support means extending between said opposite sides of the receptacle and having flexible lines at its opposite ends attached to fasteners including at least one fastener at one end of said rim removably received in said groove in the rim and at least one fastener in said groove at the opposite end of said rim.

6. A hydrotherapy system according to claim 5, wherein:

said rim extends around the entire circumference of said shell at the top;

said groove extends continuously along the entire length of said rim.

7. A hydrotherapy system according to claim 1, wherein:

the inside of said shell is concave along entire length of said first holes to prevent blockage of said first holes by a person in the receptacle.

8. A hydrotherapy system according to claim 7, wherein:

said air passageway and said water passageway extend substantially horizontally along the outside of said shell;

the outside of said shell defines the inner side of said air passageway;

and said air passageway is bounded on its outer side by a wall separating it from said water passageway and formed with said holes in said manifold means.

9. A hydrotherapy system according to claim 8, wherein:

each of said holes in said manifold means is smaller than the hole in the shell with which it is aligned;

and further comprising:

a plurality of plugs removably insertable into aligned holes in the shell and said manifold means, each of said plugs having a larger segment which is complementary in size and shape to the hole in the shell and having a smaller segment which is complementary in size and shape to the hole in said manifold means and is positioned for reception in said hole in said manifold means when said larger segment of the plug is received in the aligned hole in the shell.

10. A hydrotherapy system according to claim 5 further including manifold means defining a water passageway and an air passageway extending along the outside of said shell, said manifold means having holes leading from said water passageway into said air passageway and aligned holes leading from said water passageway into the interior of said shell.

* * * * *